United States Patent [19]

Janssen

[11] 4,230,445

[45] Oct. 28, 1980

[54] BURNER FOR A FLUID FUEL

[75] Inventor: Hermann J. Janssen, Langnau, Switzerland

[73] Assignee: Sulzer Brothers Ltd., Winterthur, Switzerland

[21] Appl. No.: 915,724

[22] Filed: Jun. 15, 1978

[30] Foreign Application Priority Data

Jun. 17, 1977 [CH] Switzerland ..... 7451/77

[51] Int. Cl.[3] ..... F23L 7/00

[52] U.S. Cl. ..... 431/116; 431/183; 431/351

[58] Field of Search ..... 431/115, 116, 9, 182, 431/183, 184, 185, 174, 284, 285, 351; 126/79; 239/399, 406, 404

[56] References Cited

U.S. PATENT DOCUMENTS

| | | | |
|---|---|---|---|
| 2,011,283 | 8/1935 | Huff | 431/116 |
| 2,850,875 | 9/1958 | Gähwyler | 431/351 X |
| 3,146,821 | 9/1964 | Wuetig | 431/115 X |
| 3,402,985 | 9/1968 | Galvin | 431/351 X |
| 3,711,243 | 1/1973 | Zink et al. | 431/351 |
| 3,917,173 | 11/1975 | Singh | 239/406 X |
| 3,985,494 | 10/1976 | Childree | 431/285 X |
| 3,989,443 | 11/1976 | Campbell | 431/174 X |
| 4,004,875 | 1/1977 | Zink et al. | 431/116 X |
| 4,023,921 | 5/1977 | Anson | 431/115 X |

FOREIGN PATENT DOCUMENTS

| | | | |
|---|---|---|---|
| 679145 | 9/1952 | United Kingdom | 431/183 |

*Primary Examiner*—Carroll B. Dority, Jr.
*Assistant Examiner*—Randall L. Green
*Attorney, Agent, or Firm*—Kenyon & Kenyon

[57] ABSTRACT

The burner is constructed with three concentric annular spaces which terminate in a ceramic muffle and a plurality of straight passages which extend coaxially through the muffle. The innermost space surrounds a burner lance and is supplied with fresh air while the other annular spaces and passages are supplied with a flue gas/air mixture from a distribution chamber. This latter chamber is connected to a take-off line of the combustion chamber in order to receive the flue gas and various means can be used to mix fresh air into the flue gas before entry into the distribution chamber.

24 Claims, 5 Drawing Figures

BURNER FOR A FLUID FUEL

This invention relates to a burner for a fluid fuel such as liquid and/or gaseous fuels.

As is known, burners, such as those used in conjuction with steam generators, generally produce various oxides of nitrogen ($NO_x$) during combustion of the fuels which are supplied to the burners. These oxides, however, can become objectionable depending on the amount which is produced.

Accordingly, it is an object of the invention to provide a burner which is capable of reducing the amount of nitrogen oxides ($NO_x$) which is produced during combustion of a fluid fuel.

It is another object of the invention to provide for a reduced nitrogen oxide production in a burner while assuring a good flame stability.

Briefly, the invention provides a burner which has a fuel supply, a first annular space for a supply of fresh air and which has a plurality of swirl-inducing elements therein, a second annular space for a supply of a flue gas/air mixture disposed about the first annular space and likewise equipped with a plurality of swirl-inducing elements, a third annular space about the second annular space for supplying a flue gas/air mixture, and a plurality of circumferentially distributed straight passages for a flue gas/air mixture disposed around the third annular space.

As extensive tests have shown, this construction of the burner reduces the $NO_x$ content of the flue gases substantially over a wide load range, and at the same time, good flame stability is achieved.

The first annular space forms a zone with little inert gas, whereby a high readiness for the fuel to be ignited is achieved. The rotation of the fresh air supplied through the first annular space serves to tear the fuel cone apart. In this zone, primary combustion under substoichiometric conditions takes place. This makes the formation of $NO_x$ more difficult. Finally, good flame stability is achieved in this zone, i.e., the flame cannot go out because of the good ignition conditions.

By supplying a flue gas/air mixture via the second annular space, a secondary combustion zone results, in which the flame temperature is kept low within certain limits due to the relatively high inert gas content. This also has the effect of making the formation of $NO_x$ more difficult and thereby, of keeping the $NO_x$ content of the flue gases produced low. The rotation of the flue gas/air mixture fed-in-via the second annular space serves to tear the fuel cone open still further.

By supplying a flue gas/air mixture through the third annular space without twist, the rotation of the flue gases is braked and the mixing of the fuel gases with the flue gas/mixture is intensified thereby. In addition, the overall mass of the flame gases is centered, i.e., there is no displacement of the flame to one side. The flue gas/air mixture which is fed-in via the straight passages achieves good mixing with the fuel gases without introducing a new twist. At high loading of the burner the amount of flue gas/air mixed in exceeds percentagewise the mixture fed-in via the second and third annular spaces. Thus, a separation of cold and hot gas streams due to the centrifugal effect is avoided. Finally, this mixing contributes to the complete combustion of the last fuel particles.

In summary, by arranging several passages as well as several adjacent annular spaces, via which gas streams of different composition are fed to combustion, a burner is obtained which in operation leads to unexpectedly low $NO_x$ contents of the flue gases produced by the combustion, and this also at relatively low load.

These and other objects and advantages will become more apparent from the following detailed description taken in conjunction with the accompanying drawings wherein:

FIG. 1 illustrates an axial cross sectional view through a burner according to the invention;

FIG. 2, simplified schematically, illustrates a cross sectional view through a steam generator which is equipped with the burner according to FIG. 1;

Figure 1:
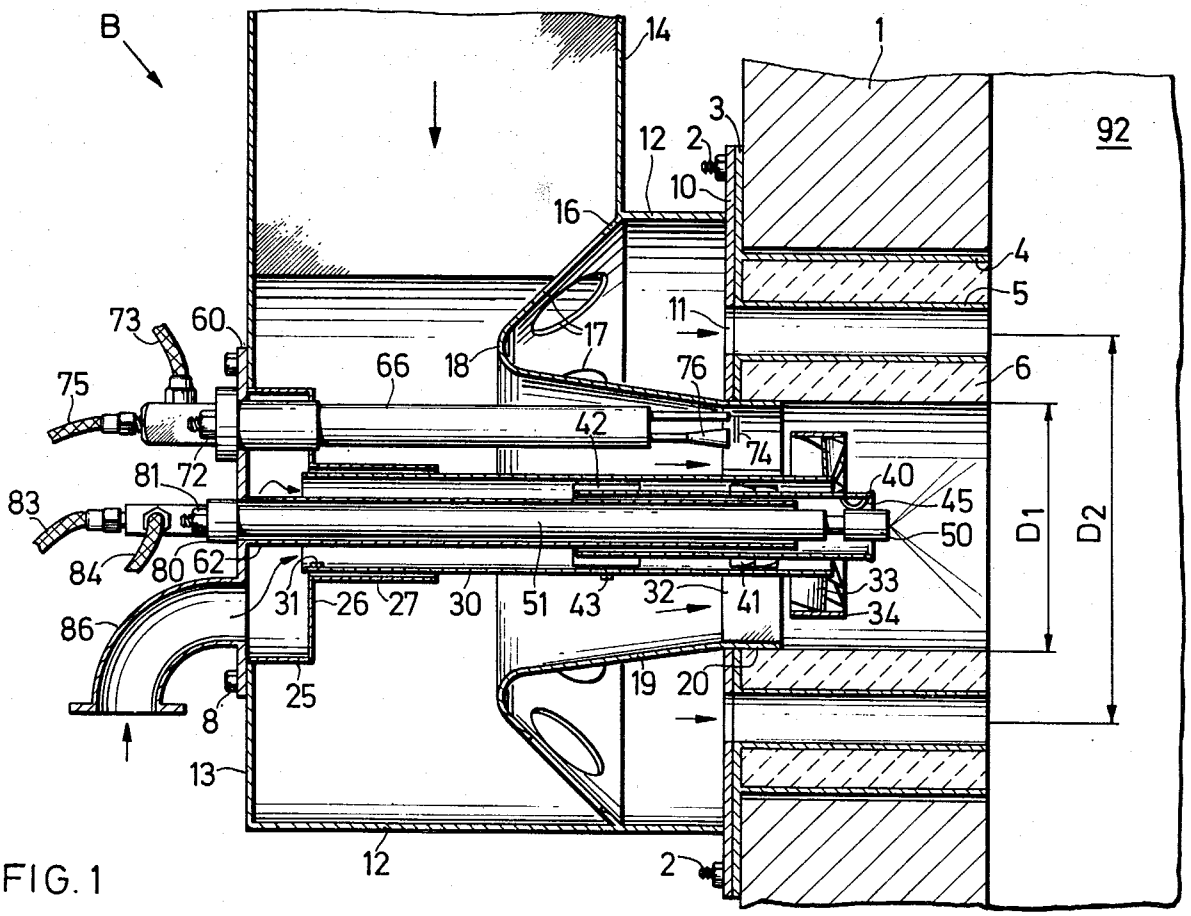

Referring to FIG. 1, the burner B is constructed for adaptation to a wall 1 of a combustion chamber 92, for example of a steam generator. As shown, the burner B is secured to the wall 1 via an annular sheet metal plate 3 of washer-like construction and a plurality of bolts 2 which pass through the plate 3. The plate 3 also carries a hollow cylinder 4 which extends through the wall 1 toward the combustion chamber 92. In addition, a muffle 6 of ceramic material is disposed within the cylinder 4 and has an inner cylindrical surface of a diameter $D_1$ coincident with the aperture of the plate 3. A plurality, e.g., sixteen, of circumferentially distributed straight passages defined by tubes 5 are disposed coaxially of and within the muffle 6. These tubes 5 are also carried on the plate 3 and extend towards the combustion chamber 92 with their axes on a pitch circle of a diameter $D_2$. This diameter $D_2$ is 1.5 times the inside diameter $D_1$ of the muffle 6 but may be 1.2 to 1.8 times the diameter $D_1$.

A base plate 10 of the burner B is also secured to the plate 3 via the bolts 2. This base plate 10 has a central opening of the same size as that of the washer 3 as well as openings 11, the arrangement and size of which correspond to the tubes 5. A cylindrical sheet metal jacket 12, which merges at the left end as viewed in FIG. 1 with a plane front plate 13, is welded to the base plate 10. This jacket 12 serves to define a distribution chamber as explained below for a flue gas/air mixture.

A sheet metal duct 14 of rectangular cross section is connected to the sheet metal jacket 12 at the top as viewed in FIG. 1.

A funnel-shaped sheet metal wall section 16, which is tapered in the direction toward the burner axis, extends from one of the intersection curves between the sheet metal jacket 12 and the sheet metal duct 14 and has several round openings 17. The left end of the wall 16, as viewed, merges via a toroidal sheet metal part 18 into a second funnel-shaped sheet metal wall 19, which is followed by a sheet metal cylinder 20. This cylinder 20 extends for a distance into the muffle 6 and rests against the muffle 6. The sheet metal body formed by the components 16, 18, 19 and 20 is welded to the base plate 10 in the region of the transition between the components 19 and 20.

A cylindrical sheet metal insert 25 is welded to the front plate 13 and protrudes inwardly. This insert 25 carries a flange 26 at the right hand end as viewed which connects to an axial tube section 27. This tube section 27, in turn, receives a tube 30 which is fastened by means of screws 31 in the tube section 27. The tube 30 is supported near the right-hand end as viewed in the sheet metal cylinder 20 via three radial arms 32 and serves, in part, as a means to define a first annular space of the burner. The tube 30 also carries several outward-pointing vane-like swirl-inducing elements 33 on the end protruding into the muffle 6. The outer ends of the elements 33 are connected together via ring 34. The ring 34 and the tube 30 thus serve as a means to define a second annular space of the burner which is equipped with the swirl elements 33. The ring 34 and the inner limit of the muffle 6 also serve as a means to define a third annular space, which has no swirl elements, of the burner. As shown, the three annular spaces are concentric to each other and immediately adjacent to each other.

A guide tube 40 is arranged inside the tube 30 and is guided in the tube 30 at the left end as viewed in FIG. 1 via radial arms 42 while being secured against axial displacement by screws 43 which secure the arms 42 to the tube 30. The guide tube 40 is equipped at the right-hand end as viewed with vane-like swirl elements 41, which extend radially outward up to the tube 30 and which generate a swirl in the same direction as the swirl elements 33 in the second annular space. The tube 30 and the guide tube 40 thus define the first annular space of the burner.

The space confined by the cylindrical sheet metal insert 25 with the flange 26 is terminated in FIG. 1 on the left side by a cover plate 60, which is fastened to the front plate 13 by means of screws 8. The cover plate 60 has a central opening through which a tube 62 extends into the guide tube 40 and surrounds an oil burner "lance" 51 of a fuel supply. The burner lance 51 is fastened at the end to the cover plate 60 via a head 80 by means of bolts 81. The other end of the burner lance 51 carries an atomizer head 50, which is supported concentrically in the guide tube 40 via three radially resilient elements 45.

Besides the burner lance 51, a pilot burner 66 is fastened to the cover plate 60 by means of bolts 72. This pilot burner 66 extends above the tube section 27 up into the vicinity of the sheet metal cylinder 20. The pilot burner 66 has a connection 73 for high voltage which is connected, in a manner not shown, to a spark gap 74. In addition, the pilot burner 66 has a gas connection 75 which is in communication with Bunsen burner-like opening 76. The burner lance 51 has a connection 83 for the supply of fuel oil and also a connection 84 for the supply of atomizing steam. A pipe elbow 86 or other connection for the supply of fresh air is attached to the cover plate 60 diametrically opposite the pilot burner 66.

Figure 2:
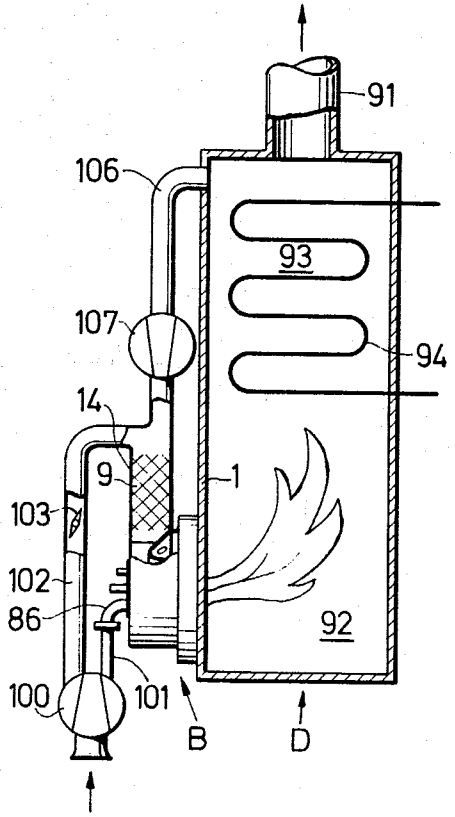

Referring to FIG. 2, the steam generator D to which the burner B is connected has a flue gas channel 93 above the combustion chamber 92, in which, as shown schematically simplified, a heating surface 94 is arranged, in which water is preheated, evaporated and optionally, superheated. The cooled-down flue gases leave the steam generator via a line 91. In addition, a take-off line 106 is connected to the steam generator D at the upper end of the flue gas channel 93 to remove a portion of flue gas. This take-off line 106 is connected via a circulating blower 107 to the sheet metal duct 14 to supply flue gas to the burner B.

A fresh air blower 100 is connected via a line 101 to the pipe elbow 86 of the burner B in order to deliver fresh air to the burner B. In addition, a means is connected between the fresh air blower 100 and the duct 14 to deliver fresh air thereto for mixing with the recirculated flue gas. This means includes a line 102 which branches from between an outlet of the fresh air blower 100 and the burner B and which extends to the duct 14 as well as a throttle 103 in the branch line 102 for controlling the air flow therethrough. Also, a static mixer 9 is disposed in the duct 14 downstream of the branch line 102 to facilitate mixing of the flue gas and air.

In the operation of the burner B, 4 to 20% of the amount of fresh air moved by the fresh air blower 100 is fed directly to the burner B via the line 101 and the pipe elbow 86, and a rotary motion is imparted to this air in the first annular space between the tube 30 and the guide tube 40 by means of the swirl elements 41. The rest of the air moved by the fresh-air blower 100 flows via the line 102 to the static mixer 9, where mixing takes place with the flue gas moved by the circulating blower 107. The flue gas/air mixture formed in this manner then passes via the sheet metal duct 14, into the burner B and, is divided in the distribution chamber defined by the duct 14 into three streams. A first substream of the mixture passes into the muffle 6 via the second annular space between the tube 30 and the ring 34 with a rotary motion which is imparted by the swirl elements 33. The second substream of the mixture passes into the muffle 6 and the combustion chamber 92 via the third annular space between the ring 34 and the muffle 6 without rotary motion. The third substream of the mixture flows via the openings 17 in the sheet metal funnel-shaped wall 16 into the chamber bounded by the base plate 10, the sheet metal jacket 12 and the sheet metal body 16, 18, 19. From there, the flue gas/air mixture passes into the combustion chamber 92 via the passages 11, 5.

The fuel oil fed-in via the burner lance 51 is first burned substoichiometrically, in the fesh air fed-in via the first annular space. A secondary combustion takes plate thereafter using the air components of the flue gas/air mixture, which is supplied with suitable turbulence via the second annular space and without turbulence via the third annular space. In order to ignite the burner, which is accomplished by means of the pilot burner 66, the supply of the flue gas/air mixture can be set low or can be switched off altogether.

Figure 3:
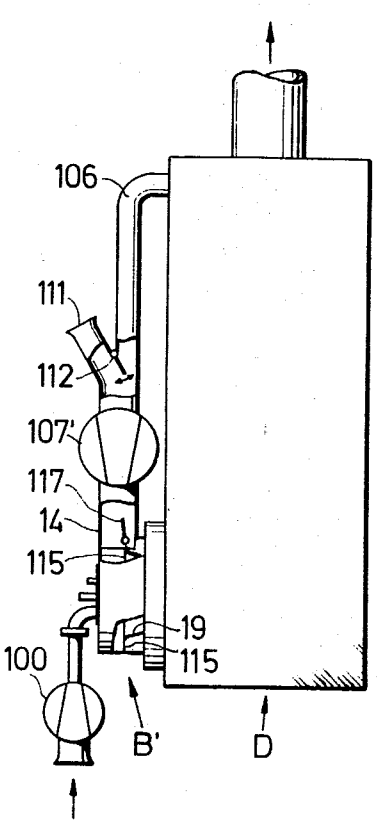
FIG. 3 illustrates a view of modified steam generator with a burner according to the invention.

Referring to FIG. 3, wherein like reference characters indicate like parts as above, the fresh air blower 100 can be connected to the burner B′ so as to move only the amount of air required for the primary combustion. The secondary air quantity supplied with the flue gas is fed-in via a blower 107′ which, on the one hand, draws-in flue gas via the line 106 and, on the other hand, fresh air via a means such as a stub 111. The mixing of flue gas and air therefore takes place in the blower 107′, the outlet of which is connected to the sheet metal duct 14. A control means, such as a pivotable vane 112, is also disposed between the stub 111 and the line 106 for controlling the amount of air and flue gas delivered to the blower 107′. As indicated, the vane 112 can be set so that the flue gas stream or the air stream can be throttled alternatively. Thus, the desired ratio of flue gas to air can be set by means of the vane 112. Contrary to the construction described in FIG. 1, the toroidal sheet metal part 18 is connected in the burner B′ according to FIG. 3 to the sheet metal jacket 12 via a plane sheet metal wall 115 arranged at right angles to the burner axis, instead of via a funnel-shaped sheet metal wall. The sheet metal wall 115 extends for some distance into the sheet metal duct 14 and a vane 117 which is pivotable about a horizontal axis is provided at the end of this wall. In this burner construction, the division of the flue gas/air mixture to the second and third annular spaces, on the one hand, and the passages (not shown), on the other hand, can be set by means of the vane 117. This is of advantage when the burner B' is operated at low load, as then, the flue gas/air mixture flows preferentially through the passages.

Figure 4:
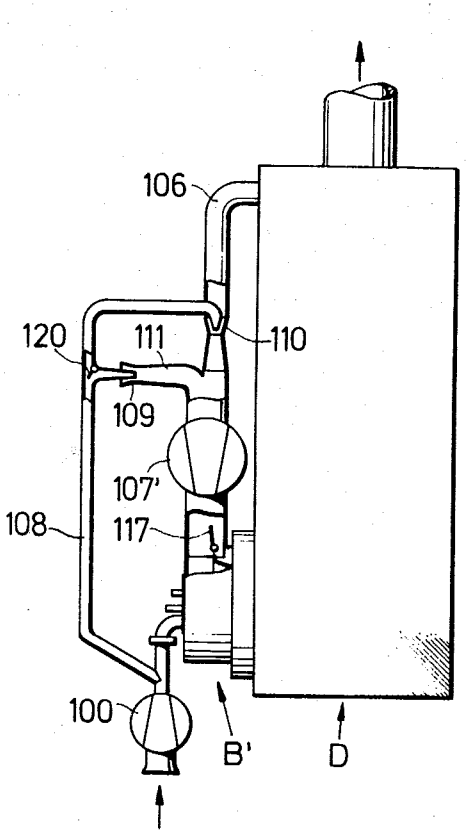
FIG. 4 illustrates a further modified steam generator having a burner in accordance with the invention.

Referring to FIG. 4, the means for delivering fresh air for mixing to the burner B' may alternatively be comprised of a branch line 108 between the blower 100' and a tapering cross-section of the take-off line 106 and an air stub 111 connected to the take-off line 106 so as to define ejectors 110, 109. In this case, flue gas is drawn from the flue gas channel by ejector action. The air nozzles of the two ejectors 109, 110 are connected via the line 108 to the outlet of the fresh-air blower 100. A throttle 120 is also provided, at the branching point of the line 108 so that the two ejectors 109, 110 can be supplied alternatively with different amounts of air. It is also possible to provide only one of the two ejectors.

Figure 5:
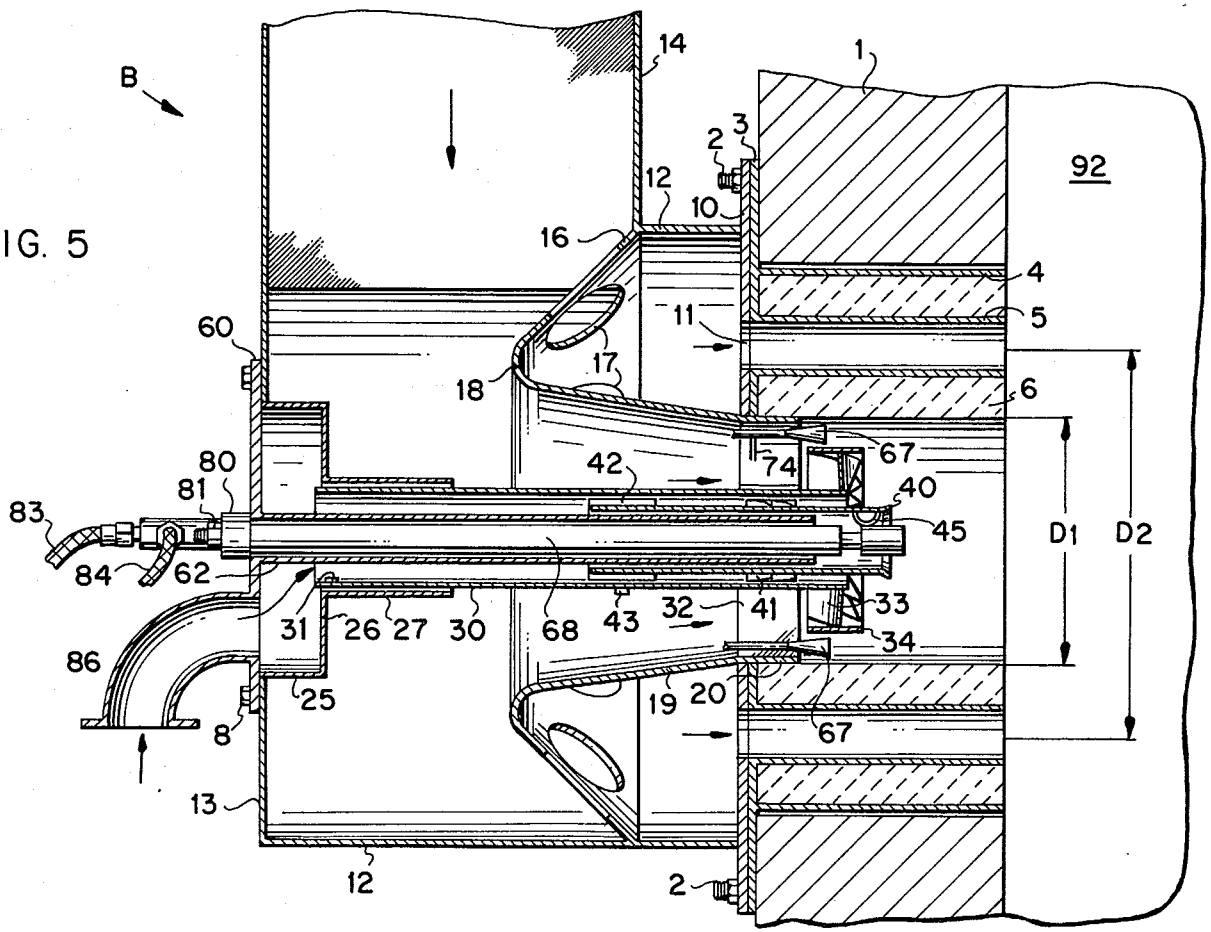
FIG. 5 illustrates a view similar to FIG. 1 of a gas fired burner in accordance with the invention.

The burners B and B' can be constructed, except for the gas-operated pilot burner 66, as pure oil burners, like the one shown in FIG. 1. The burners can also be constructed as pure gas burner. In that case, several gas burners nozzles 67 (see FIG. 5) are advantageously arranged in the third annular space, uniformly distributed over the circumference of the latter and at least one continuously burning, gas operated, so-called support burner 68 is provided in the first annular space. In addition to these two embodiments, it is also possible to construct the burners as combined burners, i.e., so that operation is possible selectably with oil and with gas. In that case, the burner comprises several gas burner nozzles in the third annular space as well as at least one support burner in the first annular space and, additionally, an oil burner lance in the center.

What is claimed is:

1. A burner for a fluid fuel, said burner comprising a fuel supply;

means defining a first inner annular space for connection to a source of fresh air and having a plurality of swirl-inducing elements therein;

means defining a second annular space for connection to a source of flue gas/air mixture about said first annular space and having a plurality of swirl-inducing elements therein;

means defining a third annular space about said second annular space for connection to a source of flue gas/air mixture; and means defining a plurality of circumferentially distributed straight passages disposed around said third annular space and connected to a source of flue gas/air mixture.

2. A burner as set forth in claim 1 which further comprises a muffle having an inner cylindrical surface defining the outside of said third annular space and having said passages extending therethrough.

3. A burner as set forth in claim 2 wherein said passages have axes disposed on a pitch circle of a diameter of 1.2 to 1.8 times the diameter of said inner cylindrical surface of said muffle.

4. A burner as set forth in claim 2 wherein said passages have a total free cross-sectional area equal to 5 to 20 percent of the cross-sectional area defined by said inner cylindrical surface of said muffle.

5. A burner as set forth in claim 1 wherein said passages are parallel to the axis of said burner.

6. A burner as set forth in claim 1 which further comprises a distribution chamber connected to said second and third annular spaces to deliver a flue gas/air mixture thereto and an annular chamber connected to said passages to deliver a flue gas/air mixture thereto, said annular chamber being separated from said distribution chamber.

7. A burner as set forth in claim 6 in combination with a combustion chamber to receive the flue gas/air mixture and fuel, a flue gas take-off line connected to said combustion chamber to remove a portion of flue gas therefrom, a duct connected between said take-off line and said distribution chamber, a circulating blower between said duct and said take-off line, an air supply stub connected to said take-off line and a control means between said take-off line and said air supply stub for controlling the amount of air and flue gas delivered to said blower.

8. A burner as set forth in claim 1 which further comprises a distribution chamber connected to said second and third annular spaces and said passages in common.

9. A burner as set forth in claim 1 which further comprises an oil burner nozzle for supplying liquid fuel, said nozzle being disposed centrally of said first annular space.

10. A burner as set forth in claim 1 which further comprises a plurality of gas burner nozzles disposed circumferentially and uniformly within said third annular space for supplying gaseous fuel thereto.

11. A burner as set forth in claim 10 which further comprises at least one gas support burner in the vicinity of said first annular space.

12. A burner as set forth in claim 1 wherein said swirl elements in said first annular space have the same twist direction as said swirl elements in said second annular space.

13. A burner as set forth in claim 8 which further comprises a fresh air blower connected to said first annular space to supply fresh air thereto.

14. A burner as set forth in claim 13 in combination with a combustion chamber to receive the flue gas/air mixture and fuel, a flue gas take-off line connected to said combustion chamber to remove a portion of flue gas therefrom, a duct connected between said take-off line and said distribution chamber, a circulating blower between said duct and said take-off line, a line connected between said fresh air blower and said duct to convey fresh air to said duct and a static mixer in said duct downstream of said line.

15. A burner as set forth in claim 13 in combination with a combustion chamber to receive the flue gas/air mixture and fuel, a flue gas take-off line connected to said combustion chamber to remove a portion of flue gas therefrom, a duct connected between said take-off line and said distribution chamber, a circulating blower between said duct and said take-off line, a line connected between said fresh air blower and a tapered cross-section of said take-off line to define an ejector therewith.

16. A burner as set forth in claim 13 in combination with a combustion chamber to receive the flue gas/air mixture and fuel, a flue gas take-off line connected to said combustion chamber to remove a portion of flue gas therefrom, a duct connected between said take-off line and said distribution chamber, a circulating blower between said duct and said take-off line, an air supply duct connected to said take-off line, and a line connected between said fresh air blower and a tapered cross-section of said air supply duct to define an ejector therewith.

17. The combination as set forth in claim 16 wherein said line is branched and a second line thereof is connected to a tapered cross-section of said take-off line to define an ejector therewith.

18. A burner for a fluid fuel comprising means defining a first annular space;

a plurality of swirl-inducing elements in said space;

a burner lance for connection to a fuel source extending through said space to deliver fuel therethrough;

means defining a second annular space about said first annular space;

a plurality of swirl-inducing elements in said second annular space;

means defining a third annular space about said second annular space;

means defining a plurality of circumferentially distributed straight passages disposed coaxially around said third annular space;

a connection for supplying fresh air from a fresh air source to said first annular space; and a distribution chamber connected to said second and third annular spaces and said passages for supplying a flue gas/air mixture thereto from a flue gas/air mixture source.

19. A burner as set forth in claim 18 which further comprises a muffle of ceramic material surrounding said third annular space to receive fuel from said lance, air from said first annular space and a flue gas/air mixture from said second and third annular spaces; said passages extending coaxially through said muffle.

20. A burner as set forth in claim 18 which further comprises a shaped sheet metal body defining an annular chamber between said distribution chamber and said passages.

21. In combination with a steam generator having a combustion chamber and a flue gas channel;

a burner for delivering a flame to said combustion chamber, said burner comprising means defining a first annular space; a plurality of swirl-inducing elements in said space; a burner lance extending through said space to deliver fuel therethrough; means defining a second annular space about said first annular space; a plurality of swirl-inducing elements in said second annular space; means defining a third annular space about said second annular space; a plurality of circumferentially distributed straight passages disposed coaxially around said third annular space; a connection for supplying fresh air to said first annular space; and a distribution chamber connected to said second and third annular spaces and said passages for supplying a flue gas/air mixture thereto;

a fresh air blower connected to said connection to deliver fresh air thereto;

a take-off line connected to said flue gas channel to remove a portion of flue gas therefrom;

a duct connecting said line to said distribution chamber of said burner;

a circulating blower between said take-off line and said duct; and means connected to one of said take-off line and said duct to deliver fresh air thereto for mixing with the flue gas therein.

22. The combination as set forth in claim 21 wherein said latter means includes a branch line connected between said fresh air blower and said duct and a throttle in said branch line for controlling an air flow therethrough.

23. The combination as set forth in claim 21 wherein said latter means includes a fresh air supply stub connected to said take-off line and a control means between said line and said stub for controlling the amount of air and flue gas delivered to said circulating blower.

24. The combination as set forth in claim 21 which further comprises a branch line between said fresh air blower and a tapering cross section of at least one of said take-off line and an air stub connected to said take-off line to define an ejector therewith.

* * * * *

UNITED STATES PATENT AND TRADEMARK OFFICE

CERTIFICATE OF CORRECTION

PATENT NO. : 4,230,445

DATED : October 28, 1980

INVENTOR(S) : Hermann J. Janssen

It is certified that error appears in the above—identified patent and that said Letters Patent is hereby corrected as shown below:

Column 4, line 38, change "plate" to --place--.

Signed and Sealed this

*Third* Day of *March 1981*

[SEAL]

*Attest:*

RENE D. TEGTMEYER

*Attesting Officer*

*Acting Commissioner of Patents and Trademarks*